US010927583B2

(12) United States Patent
Fitzgibbon et al.

(10) Patent No.: US 10,927,583 B2
(45) **Date of Patent: *Feb. 23, 2021**

(54) MOVABLE BARRIER OPERATOR APPARATUS WITH SAFETY SYSTEM OVERRIDE, AND METHOD

(71) Applicant: The Chamberlain Group, Inc., Oak Brook, IL (US)

(72) Inventors: James J. Fitzgibbon, Batavia, IL (US); Thomas Jason Jankovsky, Elgin, IL (US); Michael Lorch, Glen Ellyn, IL (US); Larry Strait, Glen Ellyn, IL (US)

(73) Assignee: The Chamberlain Group, Inc., Oak Brook, IL (US)

( * ) Notice: Subject to any disclaimer, the term of this patent is extended or adjusted under 35 U.S.C. 154(b) by 277 days.

This patent is subject to a terminal disclaimer.

(21) Appl. No.: 15/978,895

(22) Filed: May 14, 2018

(65) Prior Publication Data

US 2018/0274279 A1 Sep. 27, 2018

Related U.S. Application Data

(63) Continuation of application No. 14/505,851, filed on Oct. 3, 2014, now Pat. No. 9,970,228.

(Continued)

(51) Int. Cl.
*E05F 15/00* (2015.01)
*E05F 15/42* (2015.01)

(52) U.S. Cl.
CPC ..... *E05F 15/42* (2015.01); *E05F 2015/487* (2015.01); *E05Y 2400/57* (2013.01); *E05Y 2900/106* (2013.01)

(58) Field of Classification Search
CPC ..... E05F 2015/487; E05F 2015/486; E05F 15/41; E05F 15/42; E05F 15/487; E05F 15/57; E05F 15/668; E05Y 2400/57; E05Y 2400/50; E05Y 2400/502; E05Y 2400/506; E05Y 2400/508; E05Y 2400/51;

(Continued)

(56) References Cited

U.S. PATENT DOCUMENTS 4,319,169 A 3/1982 Kucharczyk
4,821,024 A 4/1989 Bayha (Continued)

OTHER PUBLICATIONS

Requisition by the Examiner dated Jul. 31, 2020; from corresponding Canadian Patent Application No. 2,866,051; 4 pages.

*Primary Examiner* — Johnnie A. Shablack
(74) *Attorney, Agent, or Firm* — Fitch, Even, Tabin & Flannery LLP

(57) ABSTRACT

Controlling movable barrier movement with respect to selectively overriding a safety system includes determining whether a safety system is in an operation failure or misalignment state, the safety system being configured to detect obstruction in a path of movement of a movable barrier, receiving a state change request for the movable barrier while the safety system is in the operation failure or misalignment state, determining whether a safety override condition exists, and overriding the safety system and actuating the movable barrier if the safety system is in the operation failure or misalignment state and the safety override condition exists.

24 Claims, 5 Drawing Sheets

Related U.S. Application Data

(60) Provisional application No. 61/887,057, filed on Oct. 4, 2013.

(58) Field of Classification Search
CPC ..... E06B 2009/6818; E06B 2009/6836; E06B 2009/6809; E06B 2009/6854; E06B 2009/6845
See application file for complete search history.

(56) References Cited

U.S. PATENT DOCUMENTS 5,191,268 A 3/1993 Duhame
5,285,136 A 2/1994 Duhame
5,357,183 A 10/1994 Lin
5,384,495 A 1/1995 Waggamon
5,412,297 A 5/1995 Clark
5,428,923 A 7/1995 Waggamon
5,508,511 A 4/1996 Zur
5,633,778 A 5/1997 Chang
5,903,216 A 5/1999 Sutsos
5,949,207 A 9/1999 Luebke
5,955,947 A 9/1999 Sutsos
6,020,703 A 2/2000 Telmet
6,133,703 A 10/2000 Fitzgibbon
6,181,095 B1 1/2001 Telmet
6,225,768 B1 5/2001 Cookson
6,225,904 B1 5/2001 Jaffe
6,326,754 B1 * 12/2001 Mullet ..... G07C 9/00182 318/266
6,400,112 B1 6/2002 Fitzgibbon et al.
RE37,784 E 7/2002 Fitzgibbon
6,559,775 B1 5/2003 King
6,624,605 B1 * 9/2003 Powder ..... G07C 9/00182 318/16
6,667,591 B2 12/2003 Mullet
6,732,476 B2 5/2004 Mehalshick
6,906,307 B2 6/2005 Beckerman
6,989,767 B2 1/2006 Fitzgibbon
6,995,533 B2 * 2/2006 Fitzgibbon ..... H02H 7/0851 318/266
7,019,478 B2 3/2006 Gregori
7,057,519 B2 6/2006 Study
7,071,813 B2 * 7/2006 Fitzgibbon ..... G08C 17/00 340/5.6
7,123,144 B2 10/2006 Anderson
7,127,847 B2 * 10/2006 Fitzgibbon ..... G07C 9/00182 49/28
7,161,319 B2 1/2007 Ergun
7,167,076 B2 * 1/2007 Wilson ..... G07C 9/00182 307/114
7,221,288 B2 5/2007 Fitzgibbon
7,228,883 B1 6/2007 Murray
7,248,174 B2 7/2007 Study
7,280,035 B2 10/2007 McLain
7,289,014 B2 * 10/2007 Mullet ..... E05F 15/668 340/5.7
7,327,107 B2 * 2/2008 Mullet ..... G07C 9/00182 160/188
7,327,108 B2 * 2/2008 Mullet ..... G07C 9/00309 160/188
7,498,936 B2 * 3/2009 Maeng ..... G08B 21/24 340/10.3
7,642,895 B2 * 1/2010 Fitzgibbon ..... B60R 25/00 340/5.26
7,663,502 B2 2/2010 Breed
7,679,301 B2 3/2010 Gregori
8,345,010 B2 * 1/2013 Fitzgibbon ..... E05F 15/668 340/5.71
8,368,509 B2 * 2/2013 Fitzgibbon ..... G05B 15/02 340/5.71
8,581,696 B2 * 11/2013 Ghabra ..... G07C 9/00309 340/426.36
8,643,467 B2 * 2/2014 Chutorash ..... G07C 9/00182 340/5.71
8,648,695 B2 * 2/2014 Fitzgibbon ..... G05B 15/02 340/5.71
9,122,254 B2 9/2015 Cate
9,141,099 B2 9/2015 Cate
9,249,612 B2 2/2016 Fitzgibbon
9,376,851 B2 6/2016 Cate
9,574,387 B2 2/2017 Jankovsky
9,587,420 B2 3/2017 Keller
9,644,416 B2 5/2017 Fitzgibbon
9,896,877 B2 * 2/2018 Fitzgibbon ..... E05F 15/40
9,970,228 B2 5/2018 Fitzgibbon
10,096,187 B2 * 10/2018 Deneen ..... E05F 15/70
10,138,671 B2 * 11/2018 Fitzgibbon ..... G05B 15/00
10,156,634 B2 * 12/2018 Fitzgibbon ..... G01S 17/003
10,392,860 B2 * 8/2019 Barnett ..... F16H 1/06
10,597,928 B2 * 3/2020 Cate ..... G05B 19/042
10,614,647 B2 * 4/2020 Deneen ..... E05F 15/77
2003/0150164 A1 8/2003 Mehalshick
2003/0154656 A1 8/2003 Fitzgibbon
2003/0193388 A1 * 10/2003 Ghabra ..... G07C 9/00309 340/5.61
2004/0195986 A1 * 10/2004 Fitzgibbon ..... E05F 15/668 318/280
2004/0212498 A1 * 10/2004 Peterson ..... G07C 3/00 340/539.25
2005/0017663 A1 1/2005 Anderson
2005/0044906 A1 * 3/2005 Spielman ..... G07C 9/38 70/63
2006/0038656 A1 * 2/2006 Wilson ..... G07C 9/00182 340/5.61
2010/0024302 A1 2/2010 Kakuyama
2012/0153972 A1 6/2012 Stockschlager
2013/0147600 A1 * 6/2013 Murray ..... G07C 9/00571 340/5.71
2014/0118111 A1 * 5/2014 Saladin ..... E05F 15/77 340/7.51
2014/0125499 A1 5/2014 Cate
2014/0347162 A1 11/2014 Zueras
2015/0084750 A1 * 3/2015 Fitzgibbon ..... G01S 5/14 340/12.29
2015/0096693 A1 4/2015 Fitzgibbon
2015/0300070 A1 10/2015 Wurstlein
2017/0316628 A1 * 11/2017 Farber ..... E05F 15/668
2018/0274279 A1 * 9/2018 Fitzgibbon ..... E05F 15/42
2019/0085615 A1 * 3/2019 Cate ..... H04L 67/1097
2019/0200225 A1 * 6/2019 Fitzgibbon ..... H04L 9/3273
2020/0002997 A1 * 1/2020 Fitzgibbon ..... E05F 15/668
2020/0033498 A1 * 1/2020 Fitzgibbon ..... G01V 8/20

* cited by examiner

MOVABLE BARRIER OPERATOR APPARATUS WITH SAFETY SYSTEM OVERRIDE, AND METHOD

RELATED APPLICATIONS

This is a continuation of U.S. patent application Ser. No. 14/505,851, Filed Oct. 3, 2014, which issued as U.S. Pat. No. 9,970,228 on May 15, 2018, entitled Movable Barrier Safety Sensor Override, which application claims the benefit of U.S. Provisional Patent Application No. 61/887,057, filed Oct. 4, 2013, which are all hereby incorporated by reference herein in their entireties.

TECHNICAL FIELD

The present invention relates generally to moveable barrier operators, and more specifically to safety sensors for movable barrier operators.

BACKGROUND

Various access control mechanisms are known, including, but not limited to, single and segmented garage doors, pivoting and sliding doors and cross-arms, rolling shutters, and the like. In general, an operator system for controlling such movable barriers includes a primary barrier control mechanism coupled to a corresponding barrier and configured to cause the barrier to move (typically between closed and opened positions).

Some movable barrier operator systems are equipped with safety sensors for detecting obstructions in the path of the movable barrier's movement. Safety sensors generally function to prevent a moving gate from striking an object or a person and causing damage. Typically, when an obstruction is sensed, the operator would disallow the operation of the barrier. However, safety sensors are subject to misalignment and other operation failures. For example, when optical sensors, such as a photo-eye sensor, become misaligned, the sensors would indicate an obstruction to the operator when no obstruction is actually present. Detection of a false obstruction is common because many safety sensors in the interface electronics are designed to be failsafe. That is, a failure in the link of the sensor is detected by system to be the equivalent of an obstruction, and the operator responses to the failure of a sensor in a similar manner as an obstruction. When failure occurs, users are then prevented from gaining entrance through a movable barrier even though the barrier is safe to operate. Safety sensor failure is especially a problem for residential gates and garage doors in which the movable barrier may be the primary means of entrance into the residential premise.

SUMMARY

Methods and apparatuses for controlling a movable barrier operator while overriding a safety system are described herein. One example method includes determining whether the safety system of the movable barrier control system is in an operation failure or misalignment state. The movable barrier operator may enable one or more override methods to allow for the movement of the barrier despite the state of the safety sensors. For example, the system may detect the proximity of a portable transmitter or a human operator to enable the safety system override. In another example, the system may activate a warning system before and/or during the movement of the movable barrier to warn any persons who may be in the barrier's path of movement. In yet another example, the user may manually override the safety system by pressing a combination of buttons on a portable transmitter and override the safety system without having to gain access into the premises behind the barrier.

This system has several advantages over a conventional system. In a conventional system, there is either no safety override mechanism or the user must first gain access to a stationary control panel to perform the override. Residential gates, for example, have a stationary control panel often situated inside the gate. If no pedestrian entrance is accessible, the user has to climb over the gate to access the controls to override the safety system. This is particularly inconvenient and dangerous when there is not enough driveway space to park a vehicle without obstructing street traffic. With the system disclosed herein, the user is able to override the safety system and operate the movable barrier while being outside of the gate, and, in many cases, from within his/her vehicle. These and other benefits may be clearer upon making a thorough review and study of following detailed description.

Figure 1:
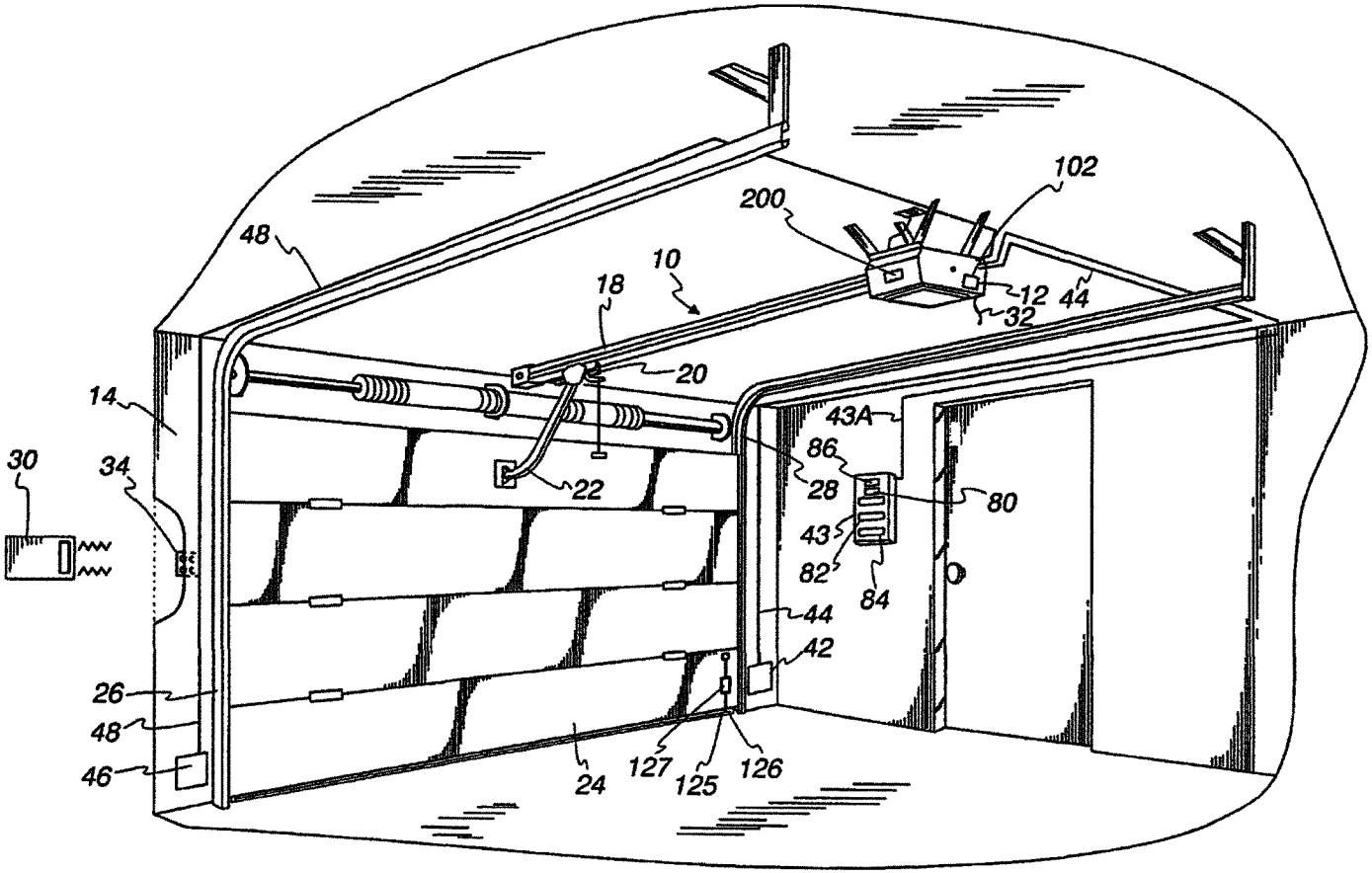
FIG. 1 is a perspective view of a garage having mounted within it a garage door operator in accordance with one or more embodiments of the invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted to facilitate a less obstructed view of these various embodiments. It will be further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

The following description is not to be taken in a limiting sense, but is made merely for the purpose of describing the general principles of exemplary embodiments. The scope of the invention should be determined with reference to the claims. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring now to the drawings and especially to FIG. 1, a movable barrier operator, which is a garage door operator, is generally shown therein and includes a head unit 12 mounted within a garage 14. More specifically, the head unit 12 is mounted to the ceiling 10 of the garage 14 and includes a rail 18 extending there from with a releasable trolley 20 attached having an arm 22 extending to a multiple paneled garage door 24 positioned for movement along a pair of door rails 26 and 28. The system includes a hand-held transmitter unit 30 adapted to send signals to an antenna 32 positioned on the head unit 12. The hand-held transmitter unit 30 is generally a portable transmitter unit that travels with a vehicle and/or a human user. An external control pad 34 is positioned on the outside of the garage having a plurality of buttons thereon and communicates via radio frequency transmission with the antenna 32 of the head unit 12. An optical emitter 42 is connected via a power and signal line 44 to the head unit. An optical detector 46 is connected via a wire 48 to the head unit 12. The optical emitter 42 and the optical detector 46 comprise a safety sensor of a safety system for detecting obstruction when the garage door 24 is closing. The head unit 12 also includes a receiver unit 102. The receiver unit 102 receives a wireless signal comprising a state change request, which is used to actuate the garage door opener.

The garage door 24 has a conductive member 125 attached. The conductive member 125 may be a wire, rod or the like. The conductive member 125 is enclosed and held by a holder 126. The conductive member 125 is coupled to a sensor circuit 127. The sensor circuit 127 transmits indications of obstructions to the head unit 12. If an obstruction is detected, the head unit 12 can reverse direction of the travel of the garage door 24. The conductive member 125 may be part of a safety system also including the optical emitter 42 and the optical detector 46.

The head unit 12 has the wall control panel 43 connected to it via a wire or line 43A. The wall control panel 43 includes a decoder, which decodes closures of a lock switch 80, a learn switch 82 and a command switch 84 in the wall circuit. The wall control panel 43 also includes a light emitting diode 86 connected by a resistor to the line 43A and to ground to indicate that the wall control panel 43 is energized by the head unit 12. Switch closures are decoded by the decoder, which sends signals along line 43A to a control unit 200 coupled via control lines to an electric motor positioned within the head unit 12. In other embodiments, analog signals may be exchanged between wall control panel 43 and head unit 12.

The wall control panel 43 is placed in a position such that an operator can observe the garage door 24. In this respect, the wall control panel 43 may be in a fixed position. However, it may also be moveable as well. The wall control panel 43 may also use a wirelessly coupled connection to the head unit 12 instead of the line 43A. If an obstruction is detected, the direction of travel of the garage door 24 may be reversed by the control unit 200.

Figure 2:
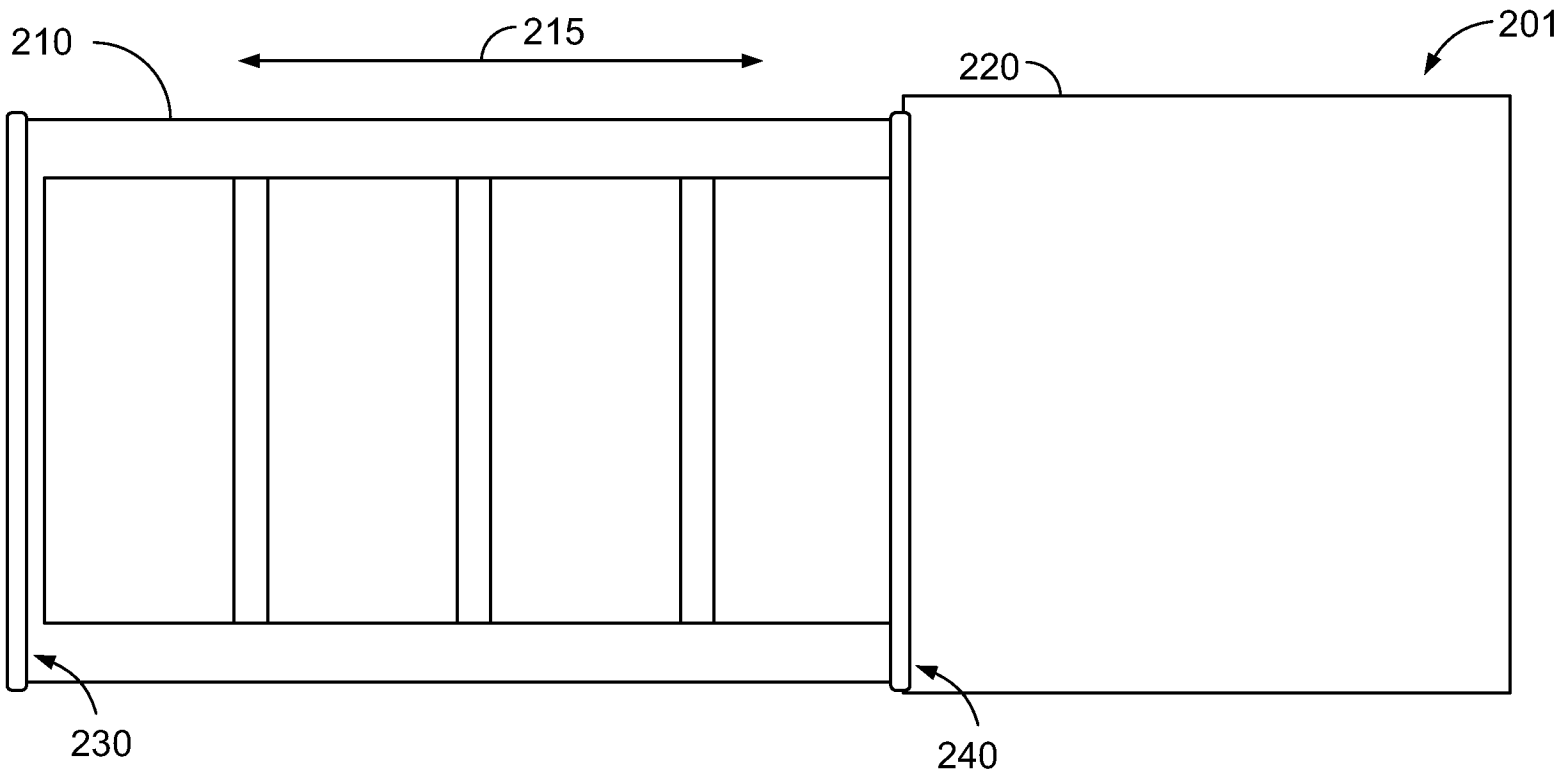
FIG. 2 is an illustration of a sliding gate in accordance with one or more embodiments of the invention.

Next referring to FIG. 2, an illustration of a sliding gate is shown. The gate 201 includes a movable portion 210 and a stationary portion 220. The stationary portion 220 may be part of a structure such as a fence or a wall. The movable portion 210 is configured to move in horizontal directions 215 to open and close the gate 201. FIG. 2 shows the movable portion 210 in a closed position. While the residential garage door systems as shown in FIG. 1 generally are equipped with only close edge sensors, sliding gates as shown in FIG. 2 may have safety sensors for both open and close edges. The movable portion 210 has a close edge 230 which may include one or more close edge safety sensors for detecting obstruction in the path of the movable portion 210 when the gate 201 is closing. The movable portion 210 further has an open edge 240 which may include one or more open edge safety sensors for detecting obstruction in the path of the movable portion 210 when the gate is opening. The open edge and close edge safety sensors may be sensors with internal contacts or obstruction of photo beams within the edge sensor, photo beams directed in order to protected the area of interest, or radio wave device or capacitive devices which protect an area about the sensing element.

The systems shown in FIGS. 1 and 2 are provided as examples of movable barrier operator system. It is understood that the methods described herein may be implemented on any type of movable barrier operator system equipped with a safety system.

Figure 3:
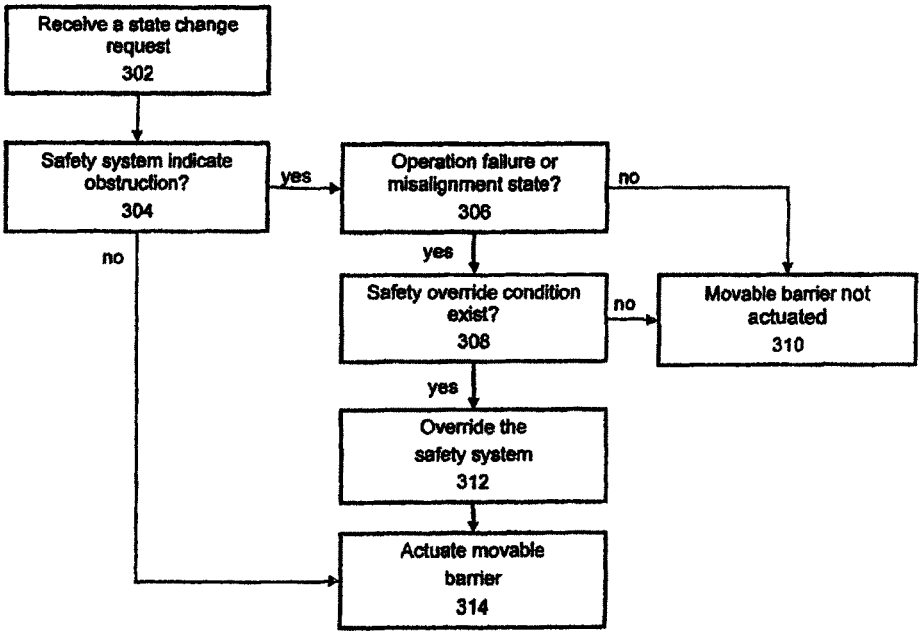
FIGS. 3-5 are flow diagrams of methods for controlling movable barrier movement in accordance with one or more embodiments of the invention.

Next referring to FIG. 3 a method for controlling movable barrier movement according to some embodiments is shown. In step 302, a state change request is received at a movable barrier operator. The state change request may be received with a radio frequency (RF) receiver receiving a signal from a portable transmitter. In some embodiments, the state change request may be received through a network connection from a mobile user device such as a cellular phone, a Smartphone, a tablet computer, a telematics system, etc.

In step 304, the system determines whether the safety system indicates an obstruction. The system reads an output form the safety system to determine whether the safety system indicates an obstruction. In some embodiments, the system is designed to be failsafe, such that when the operator does not receive a signal from one or more sensors of the safety system, the presence of an obstruction is assumed by the system. In some embodiments, the safety system may include multiple safety sensors and/or multiple pairs of safety sensors. The system will determine that there is an obstruction if at least one of the sensors in the safety system indicates an obstruction. In some embodiments, prior to step 304, the operator first determines a direction of movement in response to state change request, and only considers the sensors associated with the determined direction of movement in step 304.

In step 306, the movable barrier operator determines whether the safety system is in an operation failure or misalignment state. The safety system may be in a failure state if the connection between the safety system and the movable barrier operator is interrupted, unstable, or disconnected. In safety systems that are designed to be "failsafe," the system interprets a failure in the link between the safety system and the operator as obstruction. The safety system may be in a misalignment state if the sensors are mechanically misaligned. In some embodiments, the safety system includes one or more pairs of optical transmitter and receiver which are configured to detect obstructions when the optical link between the transmitter and the receiver is interrupted. However, when the sensors are mechanically misaligned, the optical link would also remain broken in the absence of an obstruction and would cause the safety system to indicate an obstruction to the operator even when no actual obstruction is present.

In some embodiments, the system is able to differentiate between a connection failure and a legitimate obstruction detected signal received from the safety system. For example, the system may read the voltage level of the safety system or sensor output to determine if the system and/or the sensor is still powered and/or connected. In some embodiments, the operator determines that the safety system is in an operation failure or misalignment state based on the duration of the indication of the obstruction. For example, the operator may run a timer when an indication of an obstruction is received from the safety system. If an obstruction is consistently indicated for a prescribed period of time, (for example, over five minutes, ten minutes, thirty minutes, etc.) the operator may determine that the safety system is in an operation failure or misalignment state. In some embodiments, the safety operator constantly or periodically monitors for failure or misalignment state and stores the safety system state information on a memory device prior to receiving a state change request in step 302. In 306, the operator may simply read the safety system state information stored on a memory device of the operator to determine whether the safety system is in an operation failure or misalignment state. In some embodiments, the safety system may include two or more sensors or pairs of sensors, and the states of each sensor or pair of sensors may be determined and stored individually. For example, a gate may be equipped with a close edge sensor and an open edge sensor, and the operator may separately determine whether one or both of the close edge sensor and the open edge sensor are in an operation failure or misalignment state. In some embodiments, steps 304 and 306 are only based on the sensors associated with the direction of requested movement of the movable barrier. For example, if the state change request is made to open the gate, only the obstruction indications from open edge sensors are considered in step 304 and only the states of the open edge sensors are considered in step 306. That is, if a request to open the gate is received while one or more of the close edge sensors are in an operation failure state, the open operation may still proceed directly to step 314 and actuate the barrier.

In some embodiments, if the system already determines that the safety system is in an operation failure or misalignment state, the system may skip over step 304 and ignore the output of the safety system when a state change request is received.

If the operator determines that the safety system is not in an operation failure or misalignment state in step 306, the process proceeds to step 310 and the movable barrier is not actuated. That is, if an obstruction is indicated by the safety system and the safety system is not in an operation failure or misalignment state, the operator assumes that the obstruction indication is based on actual obstruction and prevents the movable barrier from moving.

If the operator determines that the safety system is in an operation failure or misalignment state in step 306, the process proceeds to step 308 and the operator determines whether a safety override condition exists. Safety override condition may be one or more of several conditions. In some embodiments, the system determines the proximity of a portable transmitter utilized by a human operator and only allow for safety system override when the portable transmitter is within a prescribed distance from the movable barrier. Typically, the portable transmitter is the device used by the user to send the state change request, which may be a portable, handheld RF device, a vehicle installed or mounted device, a vehicle-based telematics system, a mobile device (mobile phone, smart phone, tablet, and the like) having programming allowing control of the movable barrier operator, or the like. The proximity of the portable transmitter and/or a human operator may be determined using one or more of a radio-frequency identification (RFID) sensor, a magnetic field sensor (such as a rod antenna), a toll pass sensor, an ultrasonic distance sensor, a passive infrared (PIR) sensor, an acoustic notch filter (such as an acoustic sensor), a microphone, a camera, a reflective optical sensor, a tasker light sensor, a weight pressure sensor, an air pressure sensor, a network adapter receiving a GPS coordinate of the portable transmitter, or measuring a signal strength of the portable transmitter's signal, which may include the state change request, and determining whether the signal strength is greater than a threshold value. Other ways of detecting the human operator's physical presence within the prescribed distance from the barrier are possible. In some embodiments, the presence of a human operator is detected via detecting a human operated vehicle in which the portable transmitter may be mounted or installed. The vehicle could be detected using any suitable detection means including any one or more of a loop detector, a toll-pass sensor, a distance sensor, an infrared sensor, a microphone, a camera, an optical sensor, a pressure sensor, or the like. In some embodiments, the human operator's location and proximity may be determined through the GPS information of a networked user device associated with the user such as a cell phone, smart phone, mobile computer, tablet computer, vehicle telematics system, or the like. When the proximity of the portable transmitter and/or human operator is detected, the human operator can be relied upon to manually monitor for obstructions. As such, the system may allow for the operation of the barrier despite the state of the safety system under these conditions.

As mentioned above, the system optionally activates a warning system to warn individuals in the area of the barrier of its movement. The warning system may include one or more of a flashing light and audible alarm near the barrier. In some embodiments, the warning system may also include light or sound alarms at the portable transmitter.

In addition to or alternatively to determining proximity of the user, the override condition may be triggered by receiving a user initiated input. For example, the user may flash a vehicle headlight or sound a car horn to enable the safety override. In such embodiments, the movable barrier operator systems may be equipped with suitable sensors such as a microphone, light detector, camera, and the like to detect such inputs. In another example, the user may use a portable transmitter to enable override. For instance, the user may hold down two or more buttons on the transmitter or press two or more buttons on the transmitter in a select pattern to enable safety system override. In still another example, the user may enter a safety override pass code to enable the safety override. The code may be entered through the portable transmitter, a control panel situated on the outside of the movable barrier such as the external control pad 34 shown in FIG. 1, or a networked device such as a cell phone, smart phone, mobile computer, tablet computer, vehicle telematics system, or the like.

The safety override condition may comprise a combination of two or more of the above conditions. For example, the safety override condition may require that the portable transmitter be in proximity of the barrier, and the alarm be activated to enable safety override. In another example, the safety override condition may require that the user to hold down two or more buttons on the portable transmitter for an extended period of time and that the received signal strength is greater than a prescribed threshold to override the safety system.

In one approach, the system may provide an indication to the user if an obstruction, failure, and/or misalignment are detected in steps 304 and 306 to prompt the user to perform the action(s) needed to meet the safety override condition. For example, if the state of the safety system is preventing the barrier from being actuated in response to a state change request, the system may produce a sound or flashing light to notify the human operator. The override instructions may be provided in a variety of ways such as in writing or transmitted electronically to the portable transmitter. In another approach, a short range radio signal may be broadcasted such that the user can tune to the corresponding radio station on his/her car radio to receive instructions on how to override the safety system. Information regarding the radio station may be provided in writing or transmitted to the portable transmitter. For example, the transmitter may include the text: "for safety override instructions, tune to FM 106.7," and the radio station may repeat "if you wish to override the safety system of our garage door, please press and hold the number 1 and 2 keys down for five seconds." Optionally, when the safety override condition is determined to exist in 308, the system may produce a sound or light notification to the user via either the barrier system or the portable transmitter to notify the user that the override is successful. For example, after the user holds down two or more keys on the portable transmitter for the prescribed period of time, the portable transmitter may beep to notify the user that the safety system has been successfully overridden.

If the barrier operator determines that the safety override condition has not been met in step 308, the process proceeds to step 310, and the movable barrier is not actuated. If the operator determines that the safety override condition has been met in step 308, the process proceeds to step 312, and an override of the safety system is performed. In some embodiments, if the safety system includes a plurality of sensors or sensor pairs, the operator may only override the sensor(s) that have been determined to be in an operation failure or misalignment state. For example, if a movable barrier has sensors at two heights and the lower sensor has been determined to be in an operation failure or misalignment state, the operator may still prevent the movable barrier from being actuated based on the readout of the functional sensor(s).

In step 314, the movable barrier is actuated by the operator. In some embodiments, if the safety system includes a plurality of sensors or sensor pairs, step 312 may only override the sensor(s) that have been determined to be in an operation failure or misalignment state during the movement of the movable barrier. For example, if a functional sensor indicates an obstruction during the movement of the movable barrier, the operator may still stop or reverse the direction of the movement of the movable barrier.

In some approaches, the system may require the user to send another state change request prior to actuating the movable barrier in step 314. For example, a user may enter a pass code on their networked mobile device to override the safety system and then has to press the portable transmitter to send a state change request to actuate the movable barrier. In some embodiments, the safety system is overridden only for a prescribed period of time (for example, 1 minute, 5 minutes, and the like), and a state change request must be made in that period to actuate the barrier. In some embodiments, the override only lasts for one operation. That is, each time the user wishes to operate the barrier while the safety system is in an operation failure or misalignment state, the override condition must be newly confirmed. In some embodiments, after the safety system is overridden, any state change requests received within a set period of time would actuate the movable barrier regardless of the state of the safety system.

Figure 4:
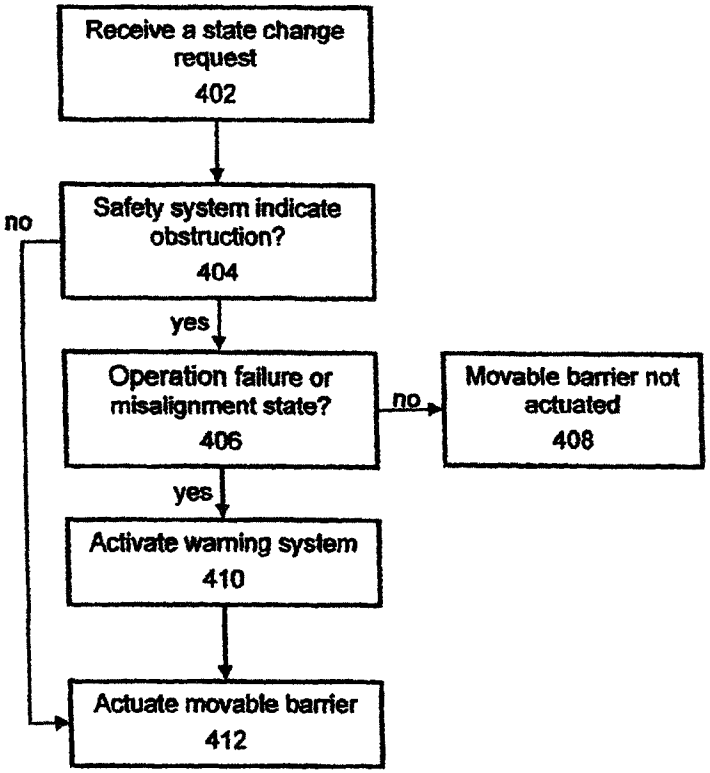

Next referring to FIG. 4, another method for controlling movable barrier movement according to some embodiments is shown. At step 402, a state change request is received. In step 404, the operator system determines whether an obstruction is indicated by the safety system. If no obstruction is indicated, the process proceeds to step 412 where the movable barrier is actuated normally. If an obstruction is indicated by the safety system in step 404, the process proceeds to 406, in which the operator determines whether the safety system is in a failure of misalignment state. If the safety system is not in an operation failure or misalignment state, the process proceeds to step 408 where the movable barrier operator is not actuated. If the safety system is determined to be in an operation failure or misalignment state, the process proceeds to step 410. In some embodiments, steps 402, 404, 406, and 408 may be the same or similar to steps 302, 304, 308, and 310 as described with reference to FIG. 3, respectively.

In step 410, a warning system is activated. The warning system may comprise one or more of a flashing light and an audio alarm at the movable barrier. The warning system generally alerts persons near the movable barrier to manually monitor for obstructions in the path of the movable barrier. In some embodiments, the warning system may also include the device that transmitted the state change request in step 402. For example, the operator may cause a portable transmitter to beep or flash to alert the person who made the state change request that the movable barrier is being operated with an overridden safety system. The warning system may be activated prior and/or during the movement of the movable barrier.

In step 412, the movable barrier is actuated. In some embodiments, step 412 may be the same or similar to step 314 described with reference to FIG. 3 above. The warning system may continue to produce warning light and/or sound until the completion of the barrier movement. In some embodiments, the movable barrier operator remains responsive to any sensors in the safety system not in a misalignment or failure state during the movement of the barrier. For example, if the close edge optical sensors are misaligned and overridden, the operator may still stop the movement of the barrier if a capacitive sensor senses an obstruction.

Figure 5:
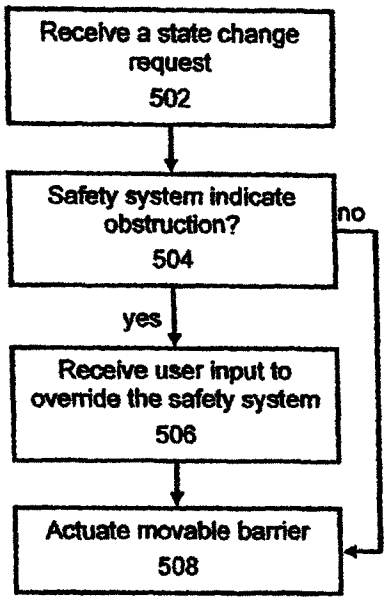

Next referring to FIG. 5, yet another method for controlling movable barrier movement according to some embodiments is shown. In step 502, a state change request is received. In step 504, the operator determines whether the safety system indicates an obstruction. If the safety system does not indicate an obstruction, the process proceed to step 508 and the movable barrier is actuated. In some embodiments, steps 502, 504, and 508 may be the same or similar to steps 302, 304, and 314 as described with reference to FIG. 3 above, respectively.

If the movable barrier operator determines that the safety system indicates an obstruction, the process may proceed to step 506 and wait for a user to input an override to override the safety system from a portable transmitter. The portable transmitter may be a transmitter that is remote from the movable barrier operator and travels with a human operator and/or a vehicle. For example, the portable transmitter may be a handheld remote or a vehicles' built-in garage door opener. In some embodiments, the portable transmitter may be a device that is accessible to the user without gaining entrance through the movable barrier including, in some cases, a portable user electronic device such as a mobile phone or tablet having programming allowing control of the movable barrier operator. User input to override the safety system may be one or more of holding down two or more buttons on the portable transmitter and pressing two or more buttons on the portable transmitter in a select pattern among other similar processes. By allowing the user to perform safety system override with a portable transmitter, the user will not need to gain access to a stationary control panel, which is often blocked by the disabled barrier, to perform the override.

If the user input to override the safety system is received in step 506, the operator actuates the movable barrier at step 508. In some embodiments, the system also activates a warning system in step 508 similar to what is described in step 410 in FIG. 4.

Optionally, between steps 504 and 506, the operator may provide a notification that an obstruction is indicated by the safety system as to prompt the user to enter the safety override input. For example, the operator may cause either a device at the movable barrier or the transmitter to make a sound or flash. In some embodiments, if the state change request is made through a user device communicating with the operator through a network connection, the operator may send a message to the user device. In some embodiments, prior or during step 506, the operator also determines whether the safety system is in an operation failure or misalignment state similar to step 306 described with reference to FIG. 3, and only moves the barrier if the safety system is in a failure and misalignment state and a user input to override the safety system is received. In some embodiments, in the method described in FIG. 5, manual safety override may be permitted even if the safety system has not been determined to be in an operation failure or misalignment state.

While FIGS. 3-5 illustrate three methods, it is understood that the steps in these methods may overlap and/or be combined. For example, step 506 of FIG. 5 may be incorporated into FIG. 4 such that a user input to override the safety system is required prior to activating the warning system in step 410. In another example, steps 412 and 508 may include overriding the safety system as described with reference to step 312. In yet another example, a system may override the safety system if the safety override condition is met as described in step 308 or if a user input is received as described in step 506. In some embodiments, a system may accept multiple method of safety override, but override may be permitted only when the safety system is in an operation failure or misalignment state for certain override methods, and may be permitted at all times for other override methods. For example, a user may be permitted to override the safety system with a pass code regardless of the state of the safety system, while an override based on the proximity of the transmitter is only permitted when the system has determined that the safety system is in an operation failure or misalignment state.

Figure 6:
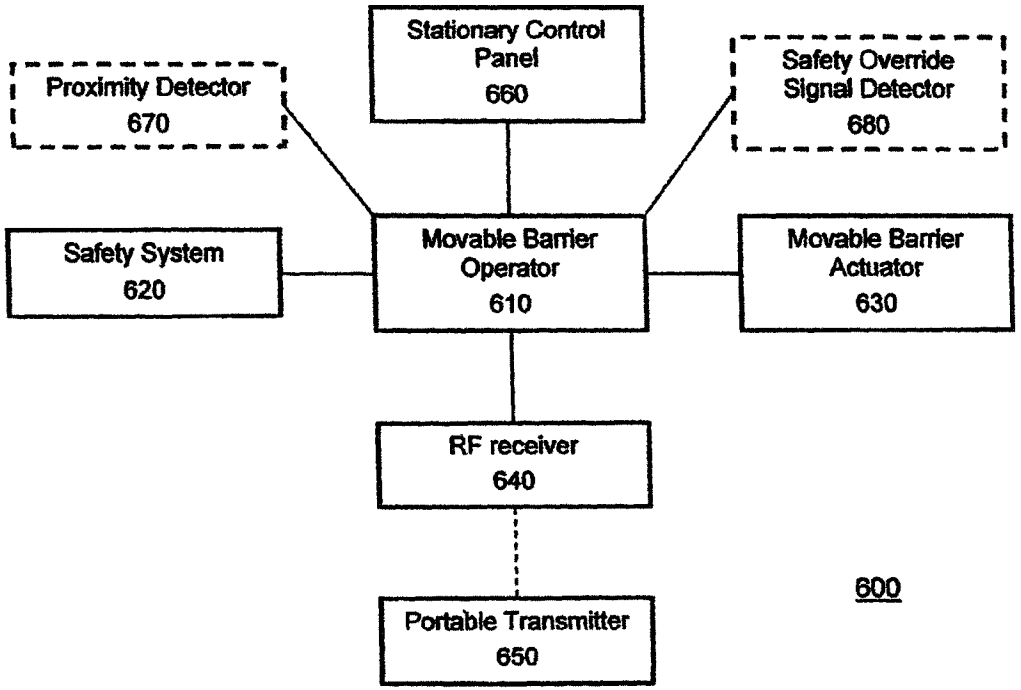
FIG. 6 is a block diagram of a movable barrier operator system in accordance with one or more embodiments of the invention.

FIG. 6 is a block diagram of a movable barrier operator system in accordance with one or more embodiments of the invention. The movable barrier operator system 600 includes a movable barrier operator communicating with a safety system 620, a movable barrier actuator 630, a stationary control panel 660, and a RF receiver 640 configured to receive signals from a portable transmitter 650. The movable barrier operator 610 may include one or more processor based devices and onboard memory. In some embodiments, the movable barrier operator 610 may include one or more buttons or switches to reset the system and/or override the safety system. The movable barrier operator 610 may be in a head unit, in a ground control box, in a wall mounted control unit, and the like. In some embodiments, the movable barrier operator 610 includes a network adopter for communicating with one or more mobile user devices such as a cellular phone, a smartphone, a portable computer, a tablet computer, a telematic system and the like over a network such as the Internet.

The safety system 620 may include one or more safety sensors. The sensors may include one or more of an open edge and close edge safety sensors. The sensors may be sensors with internal contacts or obstruction of photo beams within the edge sensor, photo beams directed in order to protected the area of interest, or radio wave device or capacitive devices which protect an area about the sensing element. For example, the safety system 620 may include the optical emitter 42, the optical detector 46, and the conductive member 125 as described in FIG. 1. Generally, the safety system 620 may include any known sensors for detecting obstruction. The safety system 620 outputs safety sensor readings to the movable barrier operator 610.

The movable barrier actuator 630 includes one or more motors for causing the movement of a movable barrier between at least two positions in response to control signals received from the movable barrier operator 610. In some embodiments, the movable barrier actuator 630 may also function as a safety sensor. For example, if a greater than normal resistance in the direction of movement of the movable barrier actuator 630 is felt, the movable barrier operator 610 may also detect an obstruction.

The RF receiver 640 is configured to receive signals from one or more portable transmitter 650 and relay the signal to the movable barrier operator 610. The RF receiver 640 may be mounted on either side of the movable barrier. The antenna 32 in FIG. 1 is an example of a RF receiver. The portable transmitter 650 generally refers to a transmitter that travels with a vehicle and/or a human operator. For example, the transmitter 650 may be a handheld remote or a vehicles' built-in garage door opener. The portable transmitter may also comprise one or more mobile user devices such as a cellular phone, a smartphone, a portable computer, a tablet computer, a vehicle-based telematic system, and the like configured to communicate with the movable barrier operator. In another approach, the transmitter 650 may be a simple remote control with two or three buttons and one or more LEDs. The portable transmitter 650 is configured to send a state change request to the movable barrier operator 610. In some embodiments, the portable transmitter 650 is also configured to send a signal indicating a holding down of two or more buttons on a transmitter, a signal indicating a pressing of two or more buttons on the transmitter in a select pattern, or signal corresponding to a pass code. The handheld transmitter unit 30 in FIG. 1 is an example of a portable transmitter 650.

The stationary control panel 660 may be a ground control box and a wall-mounted unit and the like. In some embodiments, the stationary control panel 660 may be in the same housing or premise as the movable barrier operator 610. The stationary control panel 660 may communicate with the movable barrier operator 610 through a wired or wireless connection. In some embodiments, the stationary control panel 660 is generally not a portable device and is accessed in the premise behind the barrier. The stationary control panel 660 may include one or more of a lock switch, learn switch, and a command switch. In some embodiments, the stationary control panel 660 may include a button or a switch for enabling safety override. In some embodiments, a user can manually override the safety system by holding down a state change request button on the stationary control panel 660 until the movement of the barrier is complete. The wall control panel 43 in FIG. 1 is an example of a stationary control panel 660.

Optionally, the movable barrier operator system 600 may further include a proximity detector 670 for detecting the proximity of one or more of a portable transmitter, a human operator, and a vehicle. The detector 670 is functionally in communication with the movable barrier operator 610 and may be any one or more of an RF receiver or transceiver, a radio-frequency identification (RFID) sensor, a magnetic field sensor, a loop detector, a toll pass sensor, an ultrasonic distance sensor, a passive infrared (PIR) sensor, an acoustic notch filter, a microphone, a camera, a reflective optical sensor, a tasker light sensor, a weight pressure sensor, an air pressure sensor, a network adapter receiving a GPS coordinate of the portable transmitter, or other device.

In another optional feature, the movable barrier operator system 600 may further include a safety override signal detector 680 for detecting a safety override signal from a user. The safety override signal detector 680 may be any one or more of an RF receiver or transceiver, a microphone, a camera, a light sensor, a network adapter receiving communications from the portable transmitter, a keypad situated outside of the premise, or the like. Optionally, the same structure may be used for both sensing proximity and receiving the safety override signal.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A method of controlling movable barrier movement, the method comprising:

receiving an obstruction indication associated with a safety system configured to detect obstructions in a path of movement of a movable barrier;

determining that the obstruction indication is not associated with an actual obstruction and the safety system is in an operation failure or misalignment state based on receiving the obstruction indication for a period of time exceeding a threshold indicating safety system operation failure or misalignment;

receiving a state change request for the movable barrier from a transmitter associated with a human operator;

determining a proximity of the transmitter to the movable barrier in response to receiving the state change request and the safety system being in the operation failure or misalignment state;

detecting a safety override condition based on the proximity of the transmitter being within a prescribed distance from the movable barrier; and overriding the safety system and actuating the movable barrier in response to the safety system being in the operation failure or misalignment state and the safety override condition being detected.

2. The method of claim 1, wherein the proximity of the transmitter is determined based on global positioning system (GPS) information of the transmitter.

3. The method of claim 1, wherein the proximity of the transmitter is detected by a loop detector.

4. The method of claim 1, wherein the proximity of the transmitter is determined by a toll-pass sensor.

5. The method of claim 1, wherein the proximity of the transmitter is determined by a radio frequency identification (RFID) sensor.

6. The method of claim 1, wherein the proximity of the transmitter is determined by a camera or an optical sensor.

7. The method of claim 1, wherein the proximity of the transmitter is determined by an ultrasonic sensor.

8. The method of claim 1, wherein the proximity of the transmitter is determined by a magnetic field detector.

9. The method of claim 1, wherein the proximity of the transmitter is determined by at least one of a passive infrared (PIR) sensor, an acoustic sensor, a microphone, a tasker light sensor, a weight pressure sensor, or an air pressure sensor.

10. The method of claim 1, wherein the proximity of the transmitter being within the prescribed distance from the movable barrier is determined based on detecting a flashing vehicle headlight or a sound of a vehicle horn of a vehicle associated the human operator of the transmitter.

11. The method of claim 1, wherein the proximity of the transmitter is determined based on receiving user input to override the safety system, wherein the user input comprises one or more buttons pressed on the transmitter, two or more buttons on the transmitter pressed in a select pattern, or two or more buttons on the transmitter pressed to enter a pass code.

12. The method of claim 1, further comprising activating a warning system comprising one or more of an audible alarm and a flashing light at the movable barrier while actuating the movable barrier if the safety system is in the operation failure or misalignment state and the safety override condition is detected.

13. The method of claim 1, wherein the safety system comprises two or more safety sensors, and wherein only safety sensors that have failed or are misaligned are overridden when the safety override condition is detected.

14. The method of claim 1, further comprising: providing an indication to the human operator that safety override is enabled when the safety override condition is detected.

15. A movable barrier operator apparatus comprising:

a safety system comprising a safety sensor configured to detect an obstruction in a path of movement of a movable barrier; and a movable barrier operator comprising: a processor, an antenna, a proximity detector, and a movable barrier actuator configured to cause movement of the movable barrier, wherein the processor is configured to:

receive an obstruction indication associated with the safety system;

determine that the obstruction indication is not associated with an actual obstruction and the safety system is in an operation failure or misalignment state based on receiving the obstruction indication for a period of time exceeding a threshold indicating safety system operation failure or misalignment;

receive, via the antenna, a state change request for the movable barrier from a transmitter associated with a human operator;

determine, based on a signal from the proximity detector, a proximity of the transmitter to the movable barrier in response to receiving the state change request and the safety system being in the operation failure or misalignment state;

detect a safety override condition based on the transmitter being within a prescribed distance from the movable barrier; and override the safety system and actuate the movable barrier in response to the safety system being in the operation failure or misalignment state and the safety override condition being detected.

16. The apparatus of claim 15, wherein the processor is further configured to determine the proximity of the transmitter based on global positioning system (GPS) information of received from the transmitter.

17. The apparatus of claim 15, wherein the proximity detector comprises a loop detector for detecting the proximity of the transmitter based on detecting a presence of a vehicle associated with the human operator of the transmitter.

18. The apparatus of claim 15, wherein the proximity detector comprises a toll-pass sensor for detecting the proximity of the transmitter based on detecting a presence of a vehicle associated with the human operator of the transmitter.

19. The apparatus of claim 15, wherein the proximity detector comprises a radio frequency identification (RFID) sensor for detecting the proximity of the transmitter.

20. The apparatus of claim 15, wherein the proximity detector comprises a camera or an optical sensor for detecting the proximity of the transmitter.

21. The apparatus of claim 15, wherein the proximity detector comprises an ultrasonic sensor for detecting the proximity of the transmitter.

22. The apparatus of claim 15, wherein the proximity detector comprises a magnetic field detector for detecting the proximity of the transmitter.

23. The apparatus of claim 15, wherein the proximity detector comprises one or more of a passive infrared (PIR) sensor, an acoustic sensor, a microphone, a tasker light sensor, a weight pressure sensor, or an air pressure sensor configured to detect a presence of the human operator associated with the transmitter or a vehicle associated with the human operator.

24. The apparatus of claim 15, wherein the proximity of the transmitter is determined based on detecting, with a light sensor, a flashing vehicle headlight or detecting, with an acoustic sensor, a sound of a vehicle horn to determine a presence of a vehicle associated with the human operator associated with the transmitter.

* * * * *